US006793375B2

(12) United States Patent
Anderson

(10) Patent No.: US 6,793,375 B2
(45) Date of Patent: Sep. 21, 2004

(54) REFLECTOR WITH COMPLEX PARABOLID SURFACE FOR ELONGATED LIGHT SOURCE

(75) Inventor: Douglas J. Anderson, S. Elgin, IL (US)

(73) Assignee: Honeywell International, Inc., Morristown, NJ (US)

( * ) Notice: Subject to any disclaimer, the term of this patent is extended or adjusted under 35 U.S.C. 154(b) by 7 days.

(21) Appl. No.: 10/273,413

(22) Filed: Oct. 17, 2002

(65) Prior Publication Data

US 2003/0086269 A1 May 8, 2003

Related U.S. Application Data

(60) Provisional application No. 60/346,123, filed on Oct. 19, 2001.

(51) Int. Cl.[7] ..... F21V 7/00

(52) U.S. Cl. ..... 362/304; 362/297; 362/346; 362/348; 359/546; 359/853

(58) Field of Search ..... 362/3, 16, 217, 362/257, 260, 261, 283, 296, 297, 298, 304, 341, 346–350, 364, 365, 368; 359/515, 838, 546–548, 850, 851, 852, 853, 857

(56) References Cited

U.S. PATENT DOCUMENTS

| | | | | |
|---|---|---|---|---|
| 330,742 | A | | 11/1885 | Scovil et al. |
| 678,942 | A | | 7/1901 | Cox |
| 823,392 | A | | 6/1906 | Burnfield |
| 1,224,189 | A | | 5/1917 | Maltby |
| 1,235,274 | A | | 7/1917 | Wood |
| 1,292,637 | A | | 1/1919 | Patch |
| 1,365,319 | A | | 1/1921 | Hazard |
| 1,478,564 | A | | 12/1923 | Hallett |
| 1,639,363 | A | | 8/1927 | Balsillie |
| 1,658,265 | A | | 2/1928 | Thompson |
| 1,732,884 | A | | 10/1929 | Foster |
| 1,814,326 | A | | 7/1931 | Melton |
| 1,903,330 | A | | 4/1933 | Young et al. |
| 1,913,518 | A | | 6/1933 | Smith et al. |
| 1,950,380 | A | | 3/1934 | Arras |
| 2,274,405 | A | | 2/1942 | Flaherty |
| 3,176,124 | A | | 3/1965 | Cibic |
| 3,638,010 | A | | 1/1972 | Moore |
| 3,758,770 | A | | 9/1973 | Morasz |
| 4,028,542 | A | | 6/1977 | McReynolds, Jr. |
| 4,112,483 | A | | 9/1978 | Small, Jr. et al. |
| 4,293,900 | A | | 10/1981 | Dziubaty |
| 4,308,573 | A | | 12/1981 | McNamara, Jr. |
| 4,310,876 | A | | 1/1982 | Small, Jr. et al. |
| 4,954,938 | A | * | 9/1990 | Lyons ..... 362/298 |
| 5,448,462 | A | | 9/1995 | Moran, III |
| 5,622,427 | A | * | 4/1997 | Lemons et al. ..... 362/297 |
| 5,673,030 | A | | 9/1997 | Kosich |
| 5,931,569 | A | * | 8/1999 | Anderson ..... 362/297 |
| 6,311,021 | B1 | | 10/2001 | Kosich |

OTHER PUBLICATIONS

PCT Notification of Transmittal Of The International Search Report of the Declaration for PCT/US02/33293 dated Mar. 19, 2003.

* cited by examiner

*Primary Examiner*—Thomas M. Sember
*Assistant Examiner*—Ismael Negron
(74) *Attorney, Agent, or Firm*—Welsh & Katz, Ltd.

(57) ABSTRACT

A surface mountable strobe incorporates an elongated light source and a multi-element reflector. The reflector includes a first generally circular partial parabolic reflector element with an axis of rotation which corresponds to an axis of symmetry of the source. The first reflector element produces a spike of on-axis radiant energy which substantially exceeds the off-axis output profile. A plurality of spaced apart arcuate reflector elements provides output light profiles in horizontal and vertical planes which intersect at or near the axis of the source.

43 Claims, 18 Drawing Sheets

UL 1971 Light Ouput Profile

REFLECTOR WITH COMPLEX PARABOLID SURFACE FOR ELONGATED LIGHT SOURCE

The benefit of an Oct. 19, 2001 filing date for Provisional Patent Application Ser. No. 60/346,123 is hereby claimed.

FIELD OF THE INVENTION

The invention pertains to reflectors for use in high intensity output strobe units. More particularly, the invention pertains to such reflectors which emit a spike of radiant energy in a direction generally on an axis of symmetry of a light source carried by the reflector.

BACKGROUND OF THE INVENTION

High intensity strobe units for emitting pulses of radiant energy over large viewing angles are known. One such structure is disclosed in Moran U.S. Pat. No. 5,448,462 to Moran, assigned to the Assignee hereof. Another is disclosed in Anderson U.S. Pat. No. 5,931,569 also assigned to the Assignee hereof. The disclosures of both patents are hereby incorporated by reference herein.

While known units are effective for providing alarm indicating levels of radiant energy over wide angles, they do not necessarily efficiently meet different requirements. One known light output profile for fire notification appliances is the U.L. 1971 light output profile, see FIG. 1A. Another requirement that has emerged is to provide high intensity light output over a one hundred eighty degree angle in a horizontal plane and over a ninety degree angle in a vertical plane in combination with a higher intensity optical output spike, generally perpendicular to the unit, in both planes. This type of profile, the ADA 15/75 profile, is illustrated in FIG. 1B. One known way to meet both of these requirements has been to use two different reflectors. One relative efficiently meets one standard. Another meets the other requirements.

Having to manufacture and to stock two different reflectors contributes to both manufacturing and inventory overhead. In addition, field personnel must be trained as to which of the two units must be installed in a given situation. Cost effectiveness will be enhanced without such additional overhead.

There thus continues to be a need for a unitary reflector solution to efficiently produce both of the described output patterns. Preferably, this solution will be readily manufacturable and will be aesthetically acceptable.

DETAILED DESCRIPTION OF THE EMBODIMENTS

Figure 1A:
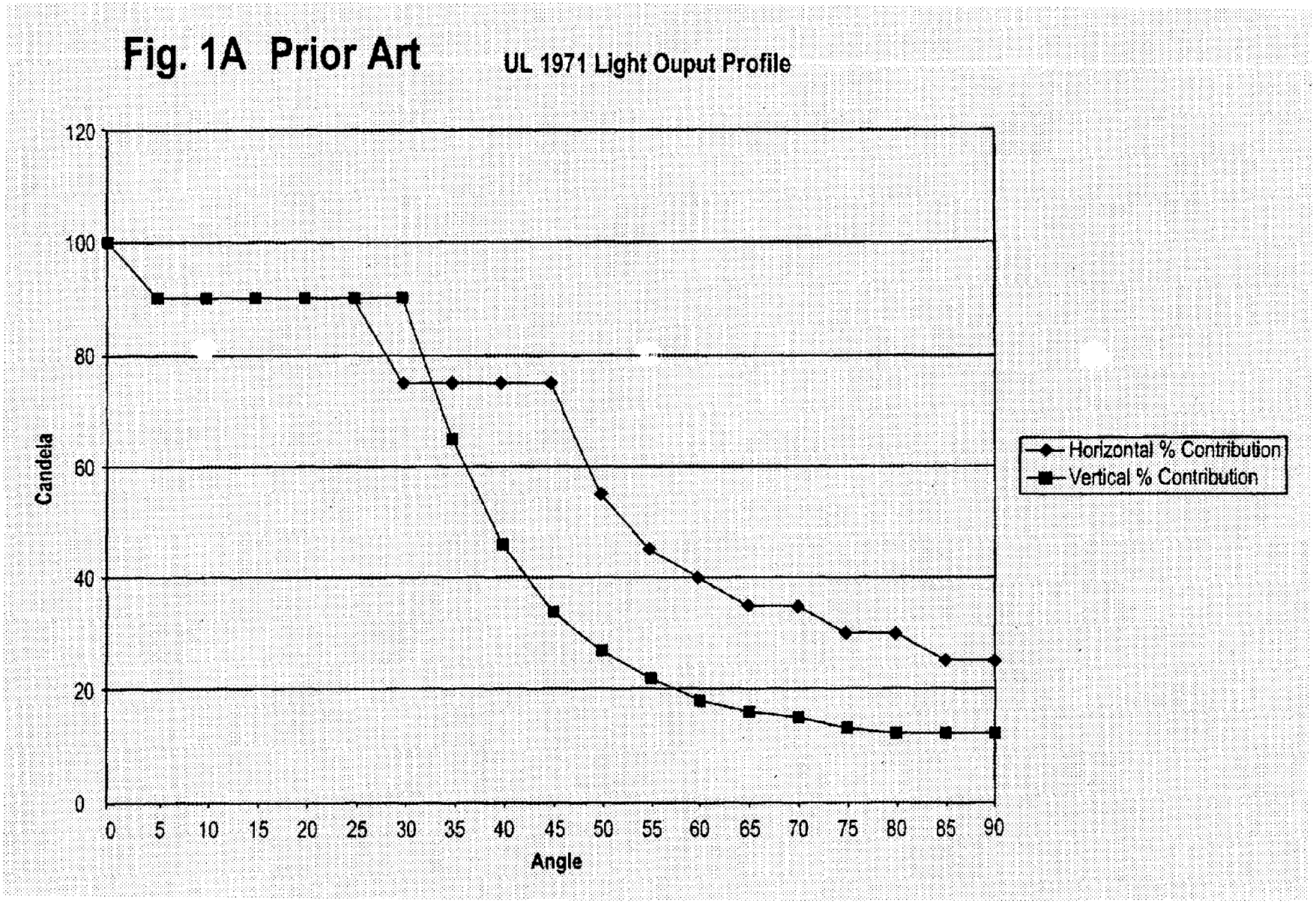
Fig. 1A Prior Art
FIG. 1A is a graph of a known light output profile, the UL1971 Standard.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Figure 1B:
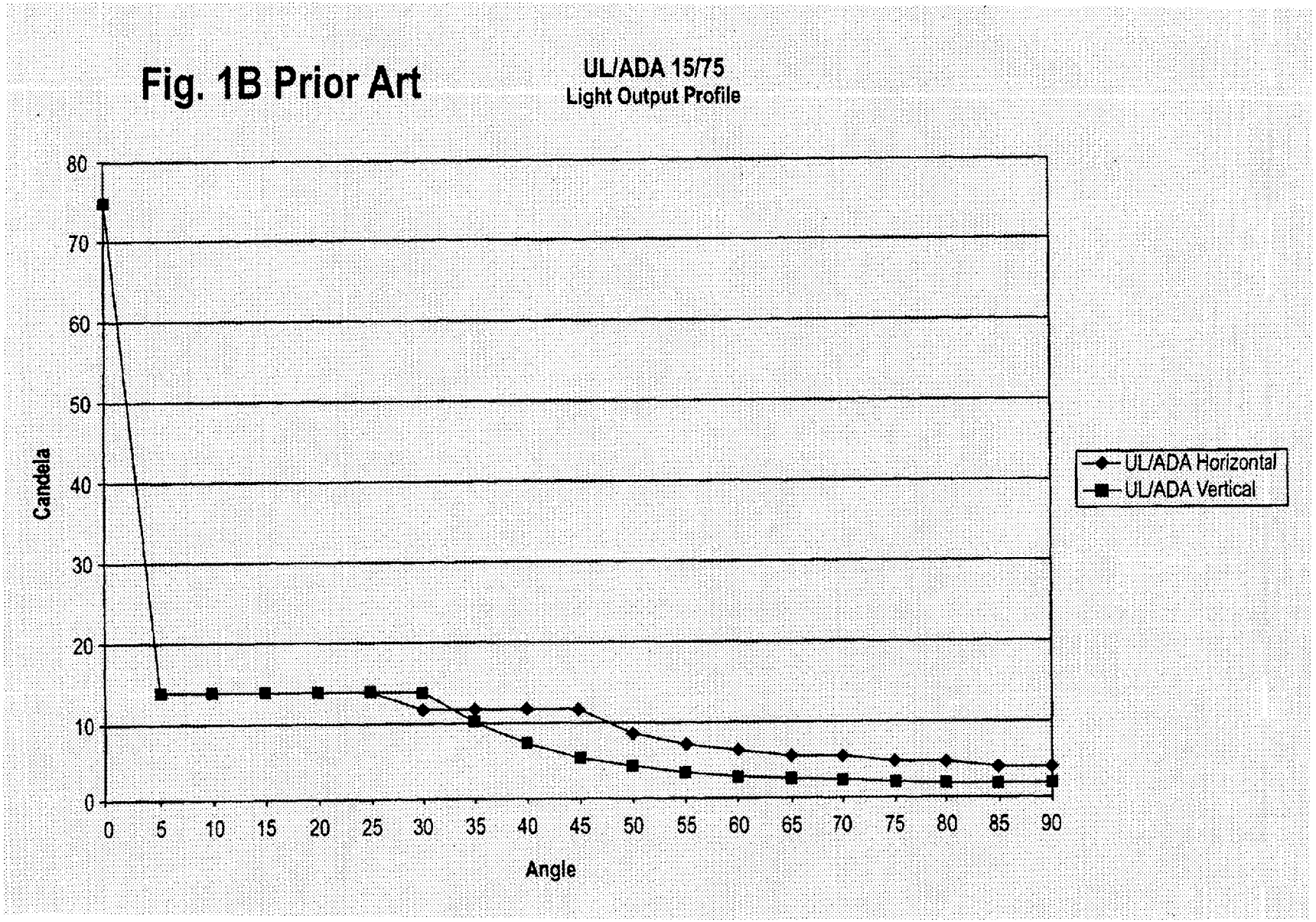
Fig. 1B Prior Art
FIG. 1B is another graph of a known light output profile, the ADA 15/75 Standard.
Figure 2:
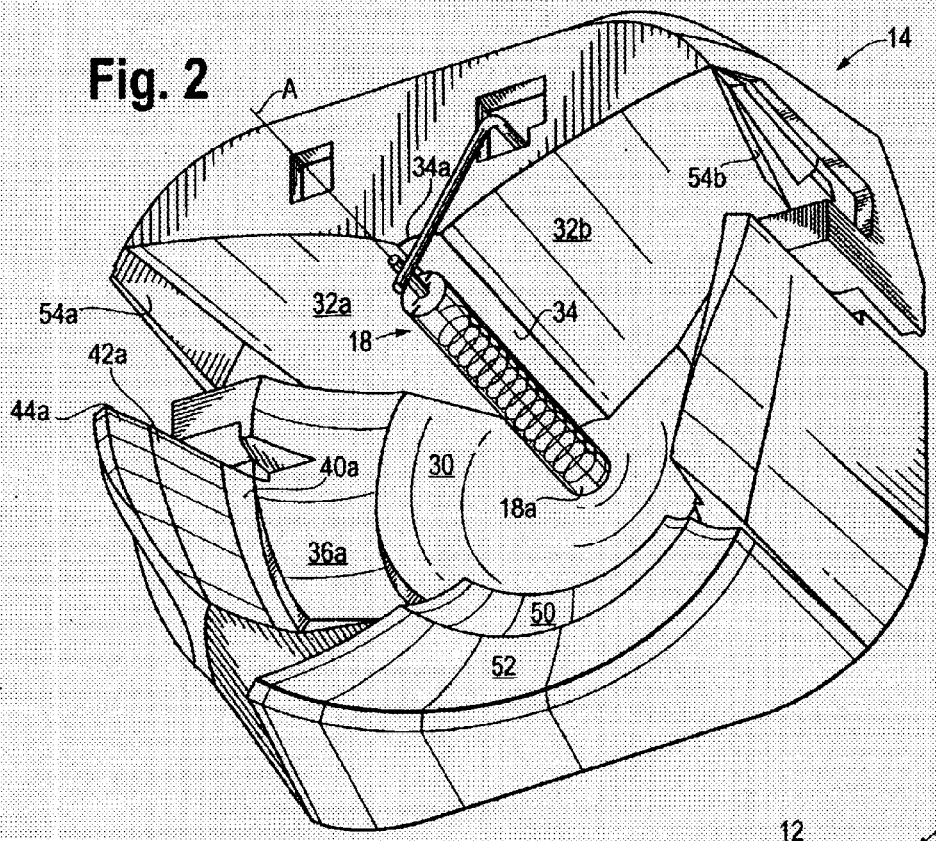
FIG. 2 is an isometric view of a reflector in accordance with the invention.

An integral, multi-element reflector can be mounted on a wall and will provide a light output profile in accordance with FIGS. 1A and 1B. It will be understood that the various surfaces of the reflector as well as the orientation of the reflector can be reconfigured for differing light output profiles without departing from the spirit and scope of the invention.

The reflector carries an elongated light source, a flashable, elongated gas tube which has an axis of symmetry which extends generally perpendicular to the reflector. When mounted on the wall, the axis of symmetry extends generally perpendicular to the wall. A spike of radiant energy in excess of 50 candela can be emitted in parallel with the axis of symmetry.

A radiant energy profile is emitted in a horizontal plane which includes the axis of symmetry. Another radiant energy profile is emitted in a vertical plane. The two planes intersect at the axis of symmetry of the bulb or source.

The on-axis spike of radiant energy is substantially reflected off of a partial parabolic reflector which is formed adjacent to a proximal end of the source. The remaining reflector elements contribute to meeting pre-determined horizontal and vertical output profiles. The exact profiles to be met are not limitations of the invention.

FIGS. 2–8 illustrate various aspects of a strobe unit 10 and reflector 14 in accordance with the invention. Strobe 10 includes a housing 12, illustrated in phantom in FIG. 3. The housing 12 carries the reflector 14 as well as drive circuitry 16. An elongated light source 18, symmetrical with respect to an axis A, is also carried on the reflector 14. A proximal end 18*a* of source 18 extends into mounting feature 18*b* which positions the source.

The housing 12 can be attached to or mounted adjacent to a generally vertical surface such as a wall W. When so mounted, the elongated light source 18, which could be a gas filled tube flashable by electronics 16, as would be understood by those of skill in the art, extends generally perpendicular to the mounting surface W. The reflector 14 can be mounted with different orientations depending on the output requirements.

Figure 3:
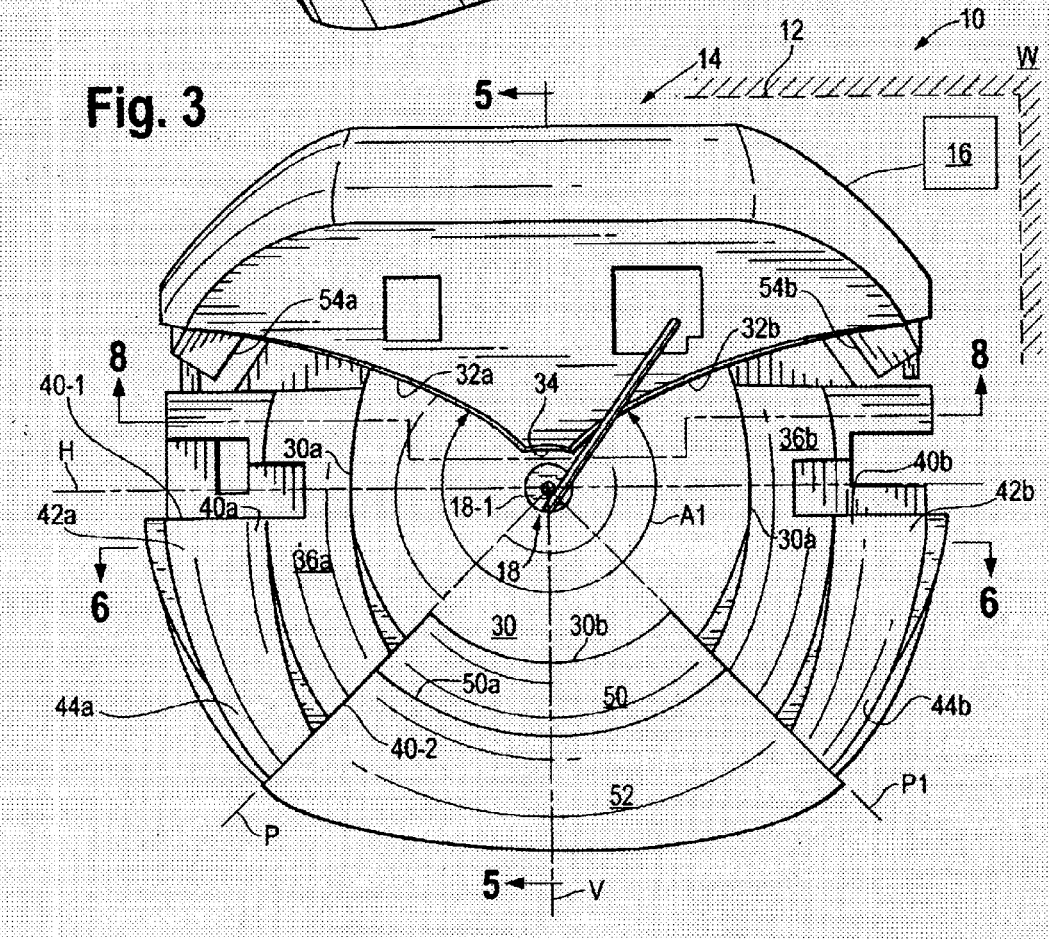
FIG. 3 is a top plan view of the reflector of FIG. 2.

The axis A of the source 18 is located at the intersection of a horizontal plane H and a vertical plane V, best seen in FIG. 3. Both planes extend generally perpendicular to the mounting surface W. Illumination profile requirements, such as exemplary profiles of FIGS. 1A,B, are defined relative to planes H,V. Planes P, P1 discussed subsequently, extend at a forty five degree angle between planes H,V.

Figure 10:
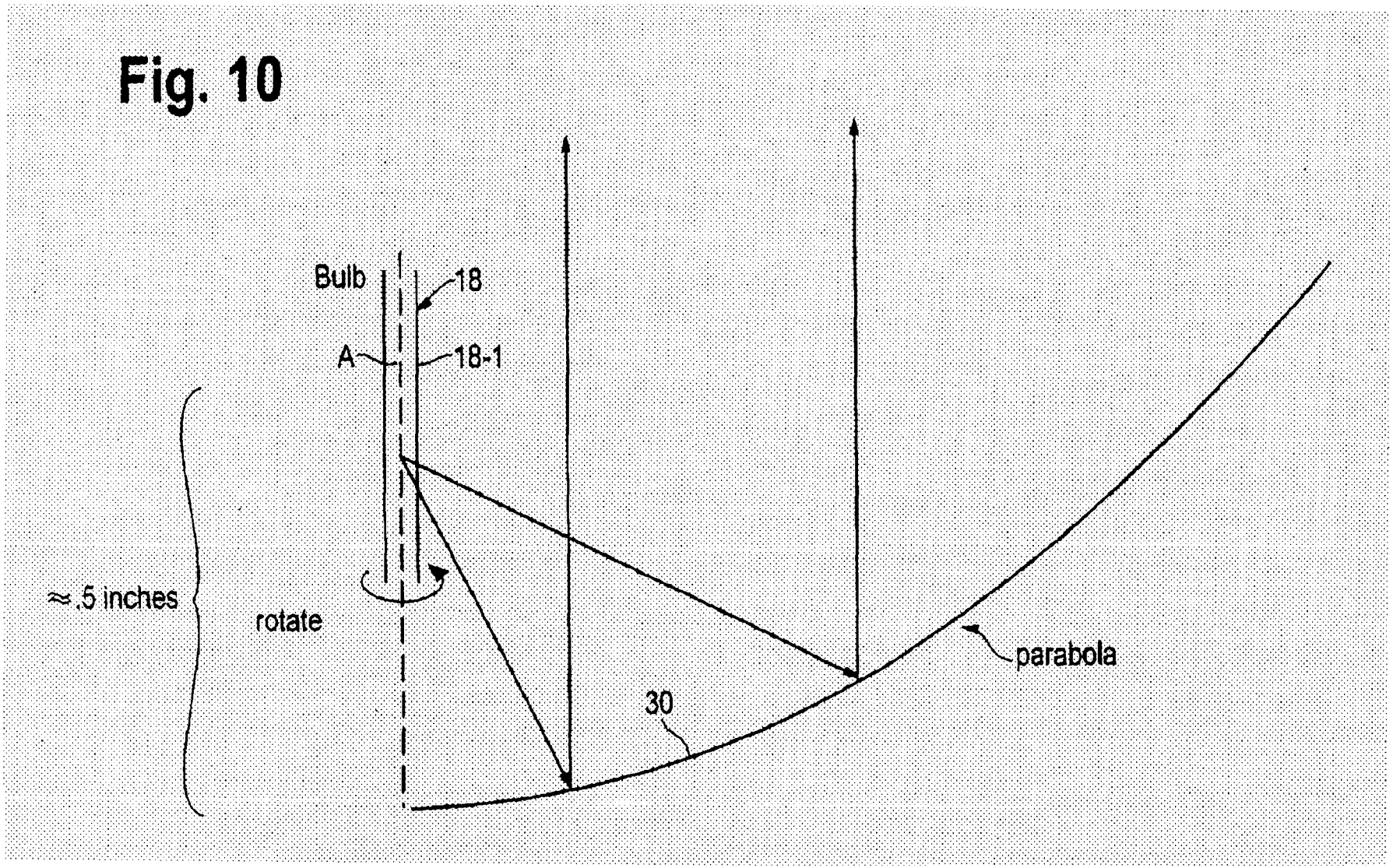
FIG. 10 illustrates characteristics of a partial parabolic reflector adjacent to the source of the reflector in FIG. 2.

Reflector 14 includes a surface 30 which is adjacent to a proximal end of source 18. Surface 30 is a partial parabolic reflective surface with a focal point located at or about a center of the emissive volume of the source 18, preferably on the order of one-half inch from the surface 30 on axis A. The surface 30 is formed by revolving a parabola, with that focal point, about the axis A, see FIG. 10.

Figure 9A:
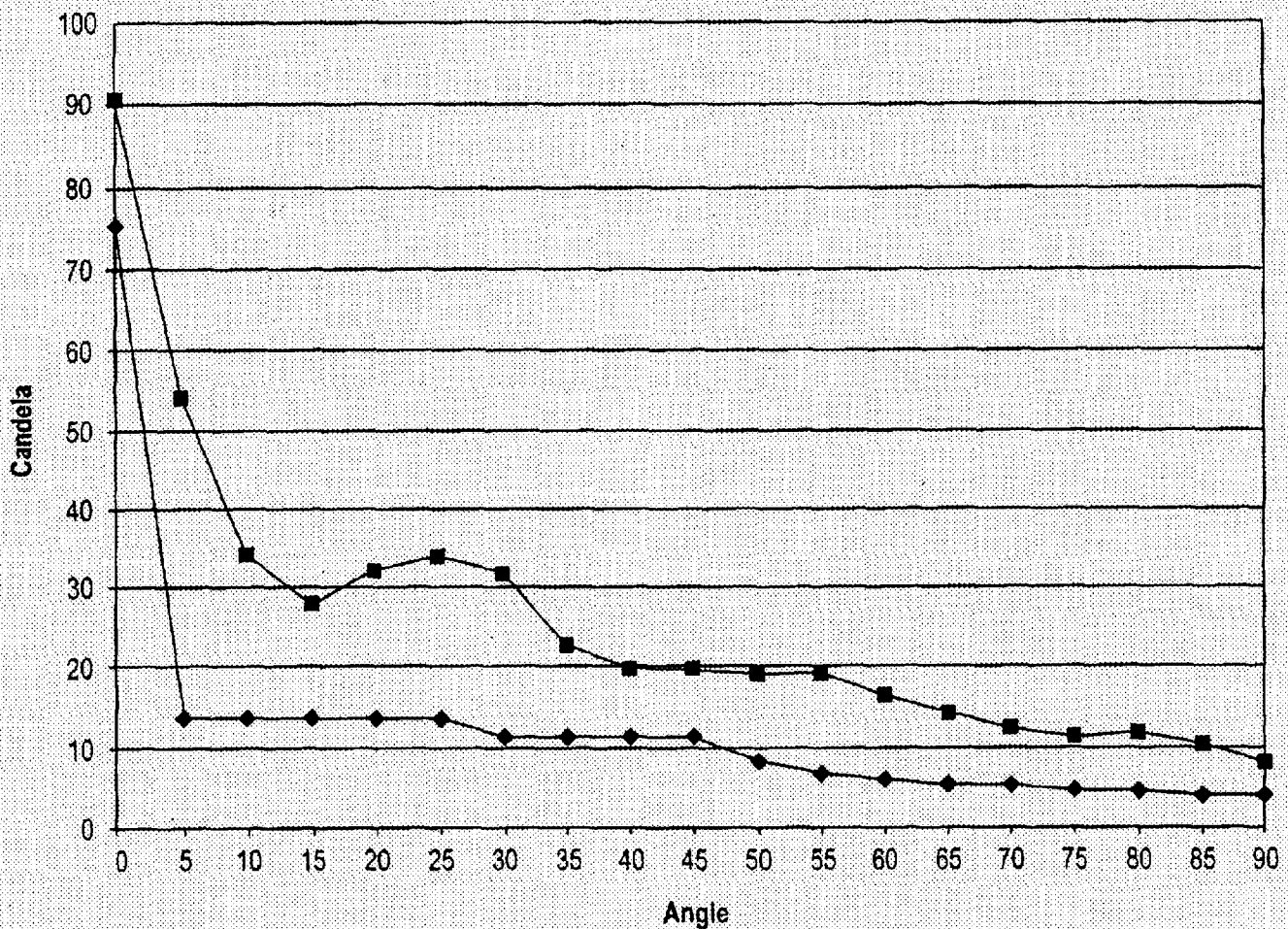
FIG. 9A is a graph of output in the horizontal plane of the reflector of FIG. 2 plotted against a composite UL/ADA profile with 75 candela output on axis.

Light emitted from source 18 is reflected off of surface 30 in a direction generally parallel to axis A to produce a spike of on-axis output light readily seen by an observer displaced from unit 10, and viewing the unit 10 on a line that lies in plane V. In the profiles of FIGS. 9A, B this spike is on the order of 90 candela.

The surface 30 extends symmetrically about the axis A through an angle A1 on the order of 270–290 degrees. It will be understood that the exact geometrically dimensions of the surface 30 may vary without departing from the spirit and scope of the invention.

Figure 11A:
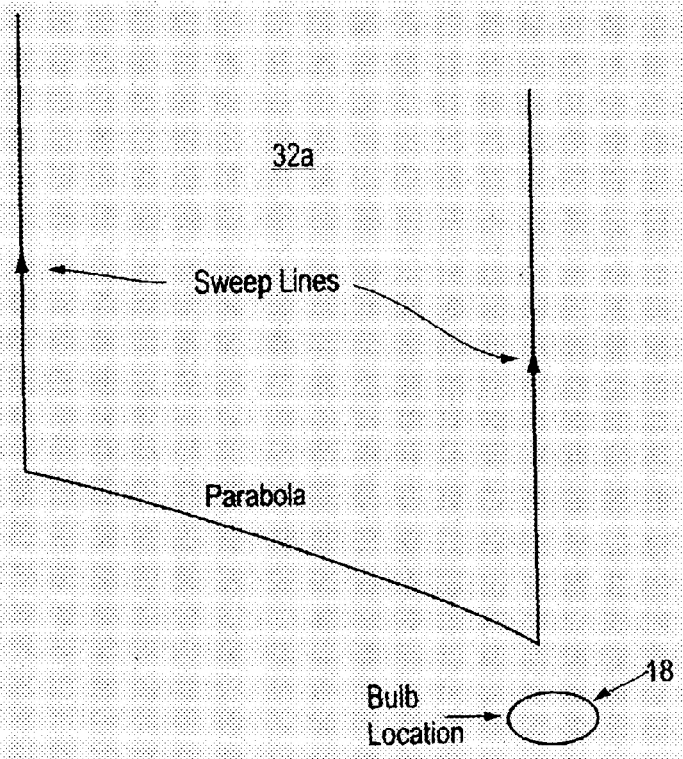
FIGS. 11A, 11B together illustrate characteristics of a pair of parabolic surfaces that extend generally parallel to the source of the reflector in FIG. 2.
Figure 11B:
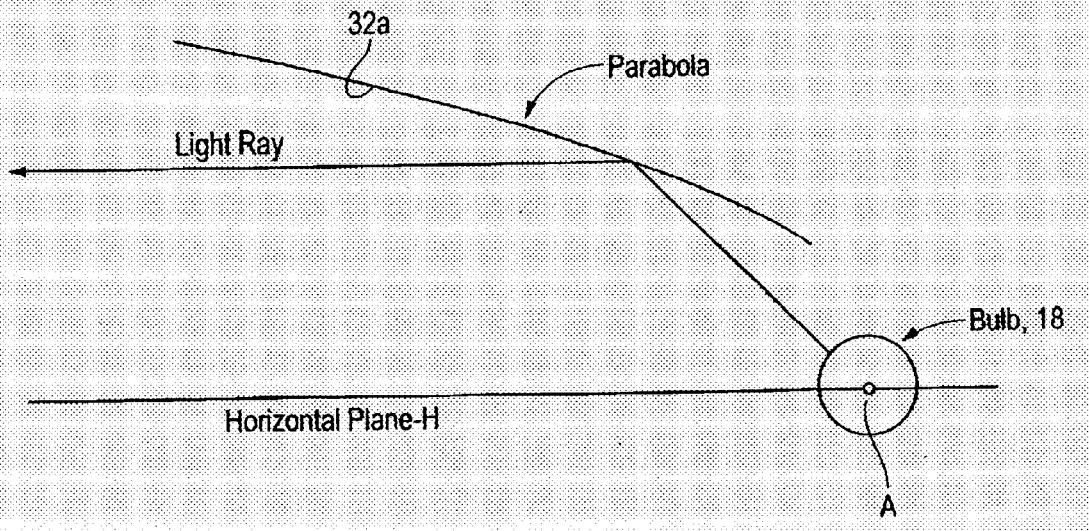

Surfaces 32*a,b* are mirror image partial parabolic surfaces that extend laterally from source 18. Each of the surfaces 32*a,b* has the same focal point as the surface 30 at the source 18, and extends linearly from the surface 30 on a line generally parallel to or slightly angled outwardly, on the order of 1–3 degrees from the axis A, see FIGS. 11A,B. The surfaces 32*a,b* direct light generally in the horizontal plane H in angles from zero degrees to ninety degrees between the horizontal plane H and vertical plane V.

Figure 12A:
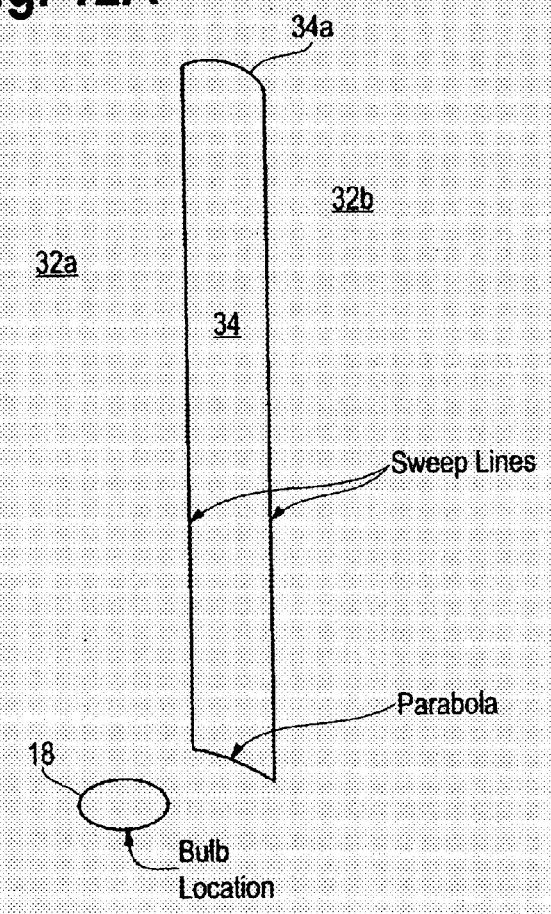
FIGS. 12A, 12B together illustrate characteristics of a partial parabolic surface, between the surfaces of FIGS. 11A, 11B, which extends generally parallel to the source.
Figure 12B:
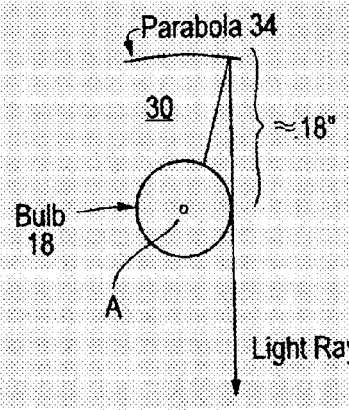

Surface 34 is a partial parabolic reflective surface which extends generally parallel to or is angled outward from the axis A, at an angle in a range of one to three degrees, symmetrically between the surfaces 32*a,b*. The surface 34 is formed of a partial parabola which has a focal point at the center of the source 18, approximately 0.18 inches therefrom. The surface 34 extends linearly from the surface 30 to a terminating edge 34*a*, see FIGS. 12A,B. The surface 34 focuses and directs light from source 30 generally in vertical plane V from five degrees to ninety degrees relative to the axis A.

Figure 15:
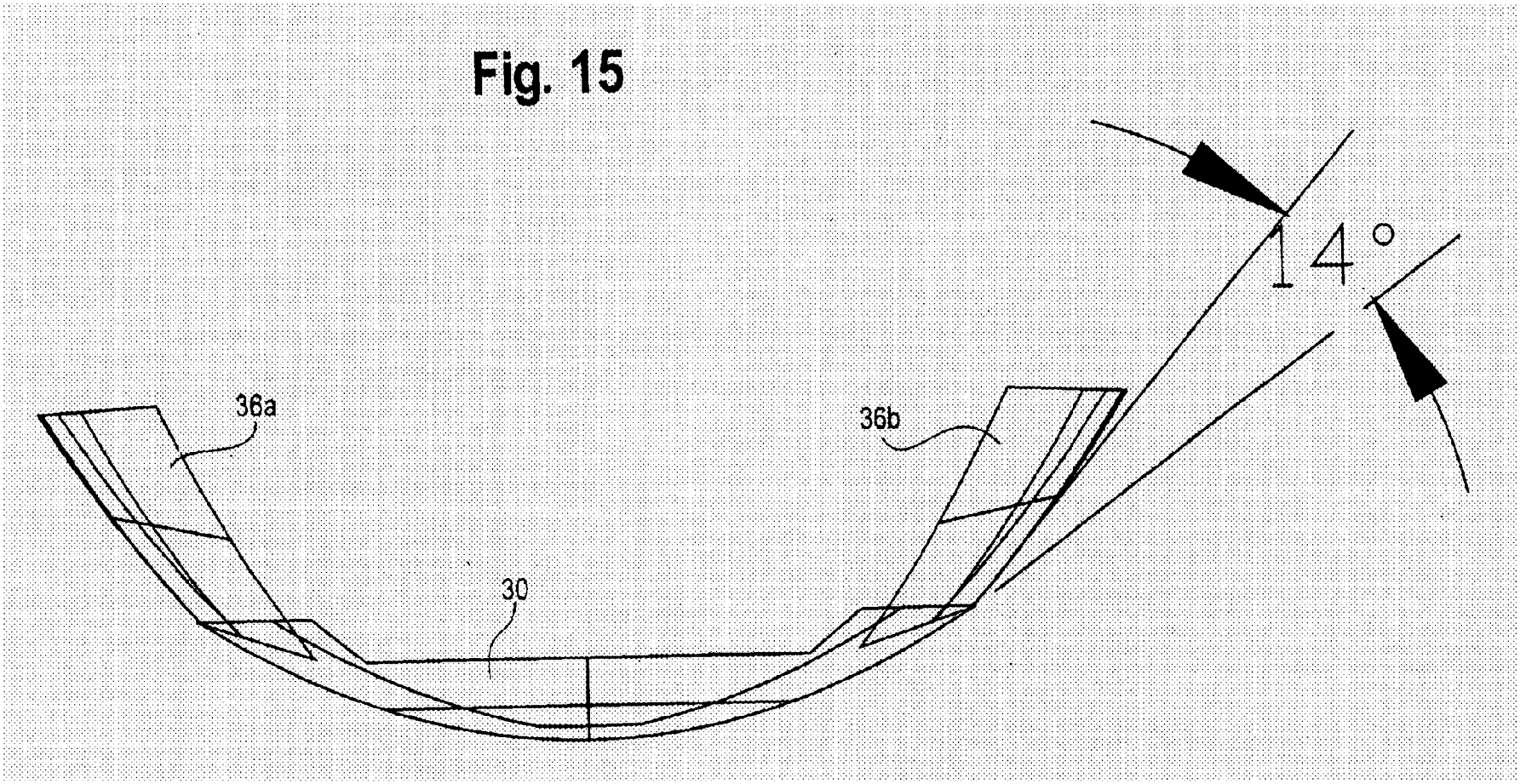
FIG. 15 illustrates characteristics of partial parabolic reflectors that extend from the surface of FIG. 10.

Surfaces 36*a,b* are each formed from an identical portion of the rotated parabola used to create surface 30. These surfaces correspond to the portion of that parabola which extends from the curved edge 30*a*. That partial parabolic surface is rotated toward or canted toward the axis A an angle in a range of 12–16 degrees, preferably 14 degrees. This angle is measured relative to the tangent of the surface 30 at the edge 30*a* see FIG. 15.

The surfaces 36*a,b* extend across an angle on the order of 70–80 degrees relative to the axis A, preferably on the order of 75 degrees. Surfaces 36*a,b* generally focus and project light from source 18 in the horizontal plane H at an angle from about five degrees to forty degrees relative to the axis A.

Reflector 14 also includes symmetrically located, stacked, surfaces 40*a,b* 42*a,b* and 44*a,b*. Each of these surfaces is formed of a swept partial parabola which aims incident radiant energy at a selected angle, relative to the axis A but generally in the horizontal plane H.

Figure 13A:
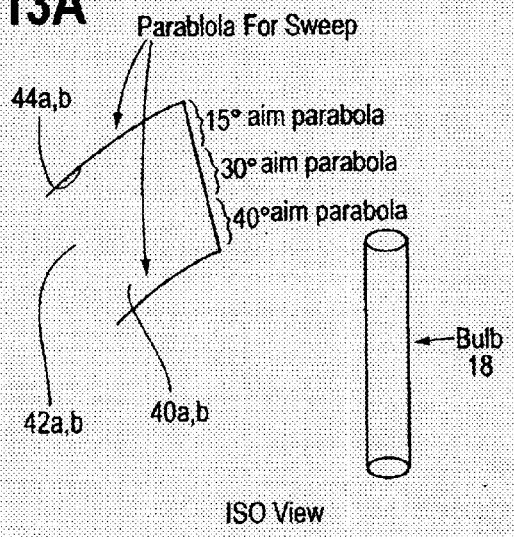
FIGS. 13A, 13B, 13C together illustrate characteristics of three partial parabolic stacked surfaces which abut one another and which are symmetrically arranged relative to the source of the reflector in FIG. 2.
Figure 13B:
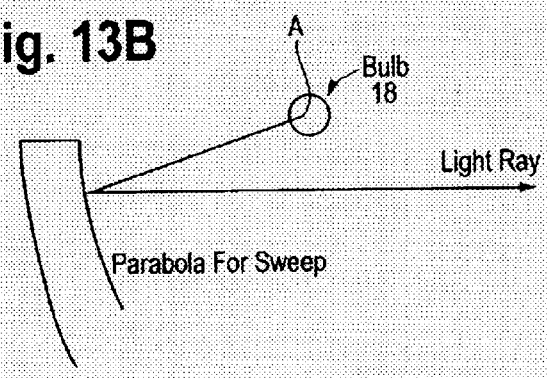
Figure 13C:
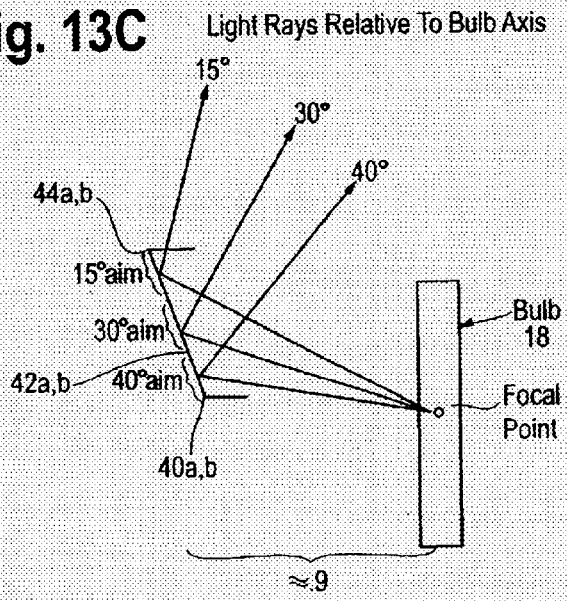

Surfaces 40*a,b* are partial parabolic and are formed of a parabola which has a focal point in the emissive center of source 18, about nine tenths of an inch from the surface. The parabola is oriented to project light rays at an angle on the order of forty degrees relative to the axis A in the horizontal plane H, see FIGS. 13A,B,C. The aiming parabola is then swept along a parabolic curve to provide the surfaces 40*a,b* which will in turn project the rays parallel to the horizontal plane at 40–45 degrees relative to the axis A. The surfaces 40*a,b* extend between surface 40-1, at the periphery of the source 18 to the plane P, surface 40-2, an angle on the order of forty-five degrees on both sides of plane V.

Surfaces 42*a,b* aim incident rays relative to the axis A on the order of thirty degrees. Surfaces 44*a,b* aim incident rays relative to the axis A on the order of fifteen degrees. These surfaces are formed of discrete, swept, partial parabolas as are surfaces 40*a, b*. Surfaces 40*a,b* 42*a,b* and 44*a,b* reflect incident rays to contribute to the light output profile in the horizontal plane H.

It will be understood that variations in the surfaces 40*a,b* 42,*a,b* and 44*a,b* come within in the spirit and scope of the present invention. The exact details of those surfaces are not limitations of the invention. Alternately, multiple parabolic surfaces such as surfaces 36*a,b* could be used instead of surfaces such as 40*a,b* 42*a,b* and 44*a,b*.

Surfaces 50, 52 which extend arcuately from surface 30 are partial parabolic surfaces formed from extensions of the same parabola as formed surface 30. Surface 30 is bounded in part by a curved periphery 30*b* displaced from source 18.

Periphery 30*b* extends through plane V and is preferably symmetrical with respect thereto. The curvatures of periphery 30*a* and 30*b* are different in that periphery 30*b* is closer to axis A than is periphery 30*a*. Periphery 30*b* is inset into surface 30 and is the interface to surface 50.

Figure 16:
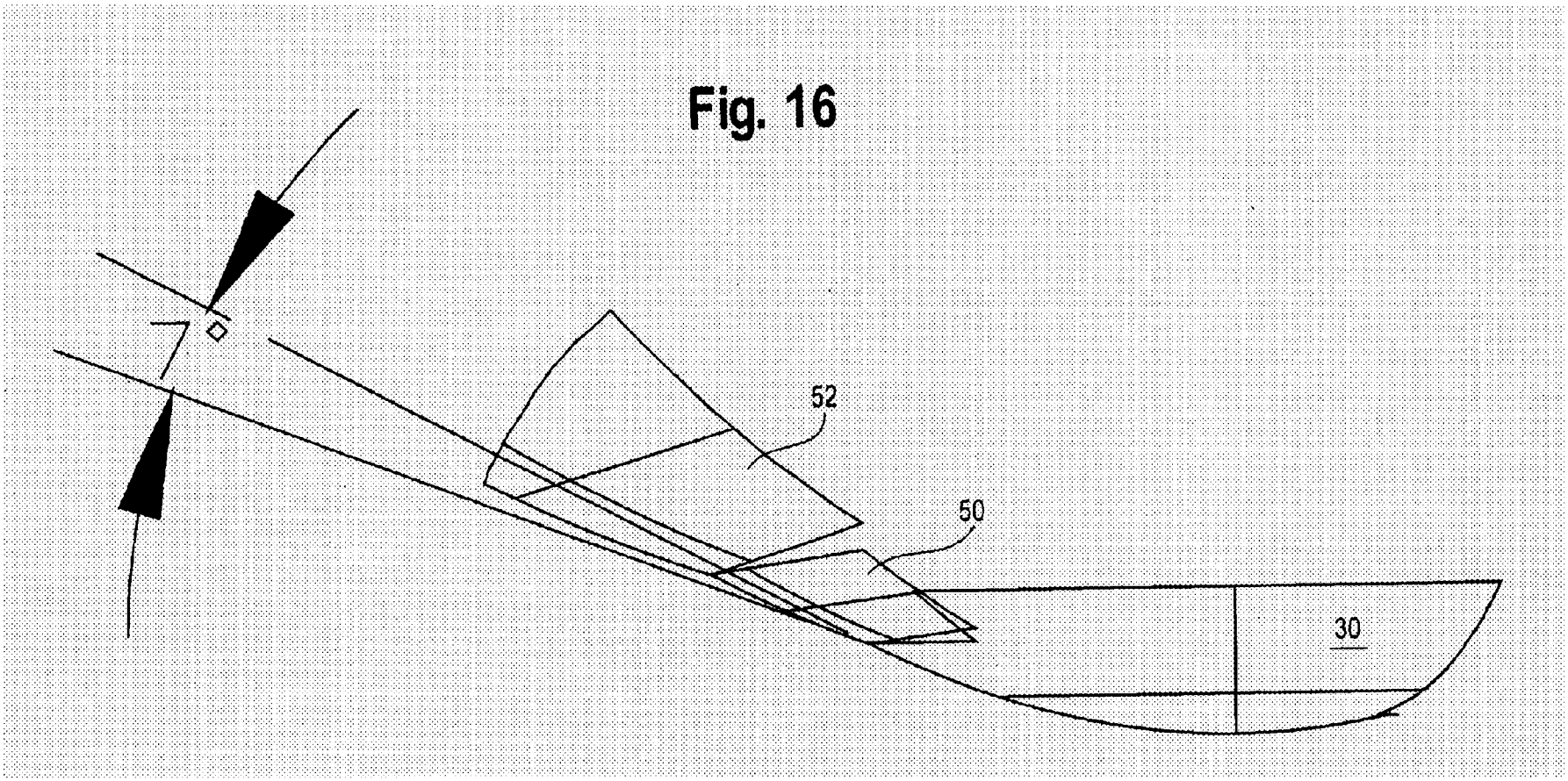
FIG. 16 illustrates characteristics of a partial parabolic reflector that extends from the surface of FIG. 10.
Figure 17:
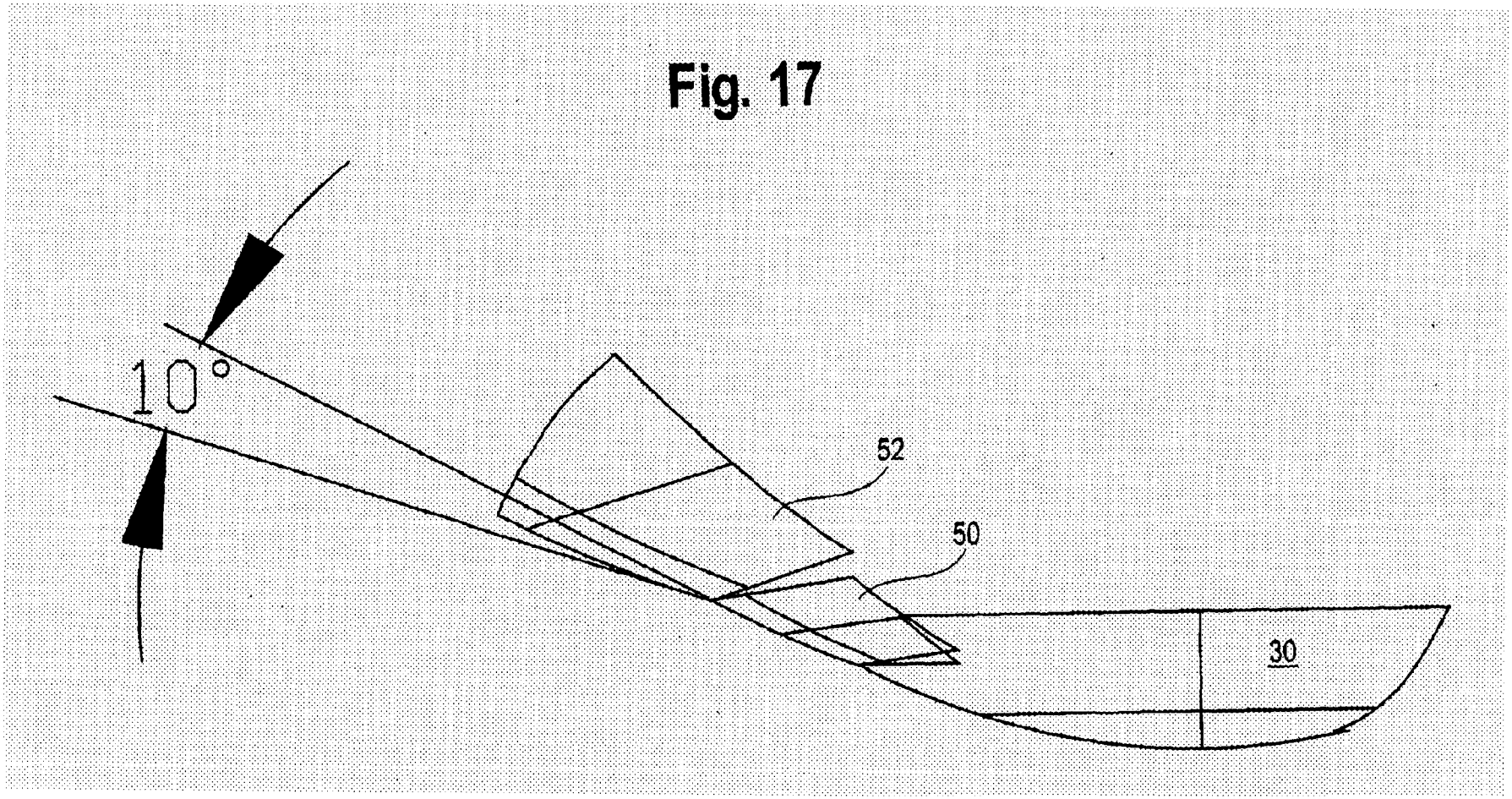
FIG. 17 illustrates characteristics of a partial parabolic reflector that extends from the surface of FIG. 16.

Surface 50 is rotated or canted away from a tangent to surface 30, best seen in FIG. 16, at an angle in a range of five to nine, preferably seven, degrees. Surface 50 terminates at a distal periphery 50*a* displaced from surface 30*b*. Surface 52, a further extension of the surface formed by the parabola for surface, 30 extends from periphery 50*a*, symmetrical relative to plane V. Surface 52 is rotated or canted away from a tangent to surface 50, at periphery 50*a* at an angle in a range of seven to fourteen, preferably ten degrees, best seen in FIG. 17.

Surface 50 focuses and projects light from source 18 generally in vertical plane V through an angle of zero degrees to forty five degrees relative to the axis A. Surface 52 focuses and projects light from source 18 generally in vertical plane V in a region from fifteen degrees to fifty five degrees relative to the axis A. Surfaces 50, 52 extend through a ninety degree angle bisected by the plane V.

Table I, following, illustrates the contribution in the horizontal plane H, measured from the axis, for zero degrees, twenty five degrees and forty five degrees. At ninety degrees virtually all of the light is contributed by source 18 and respective surface 32*a, b*.

TABLE I

| Surface | 0 Degrees | 25 Degrees | 45 Degrees |
|---|---|---|---|
| 30 | 91% | 12% | 0% |
| 32 a or b | 0% | 10% | 43% |
| 36 a or b | 0% | 44% | 0% |
| 40 a or b | 0% | 3% | 14% |
| 42 a or b | 0% | 13% | 22% |
| 44 a or b | 2% | 10% | 0% |
| 50 | 7% | 0% | 0% |
| Source 18, Direct | 0% | 8% | 21% |
| Total | 100% | 100% | 100% |

Figure 9B:
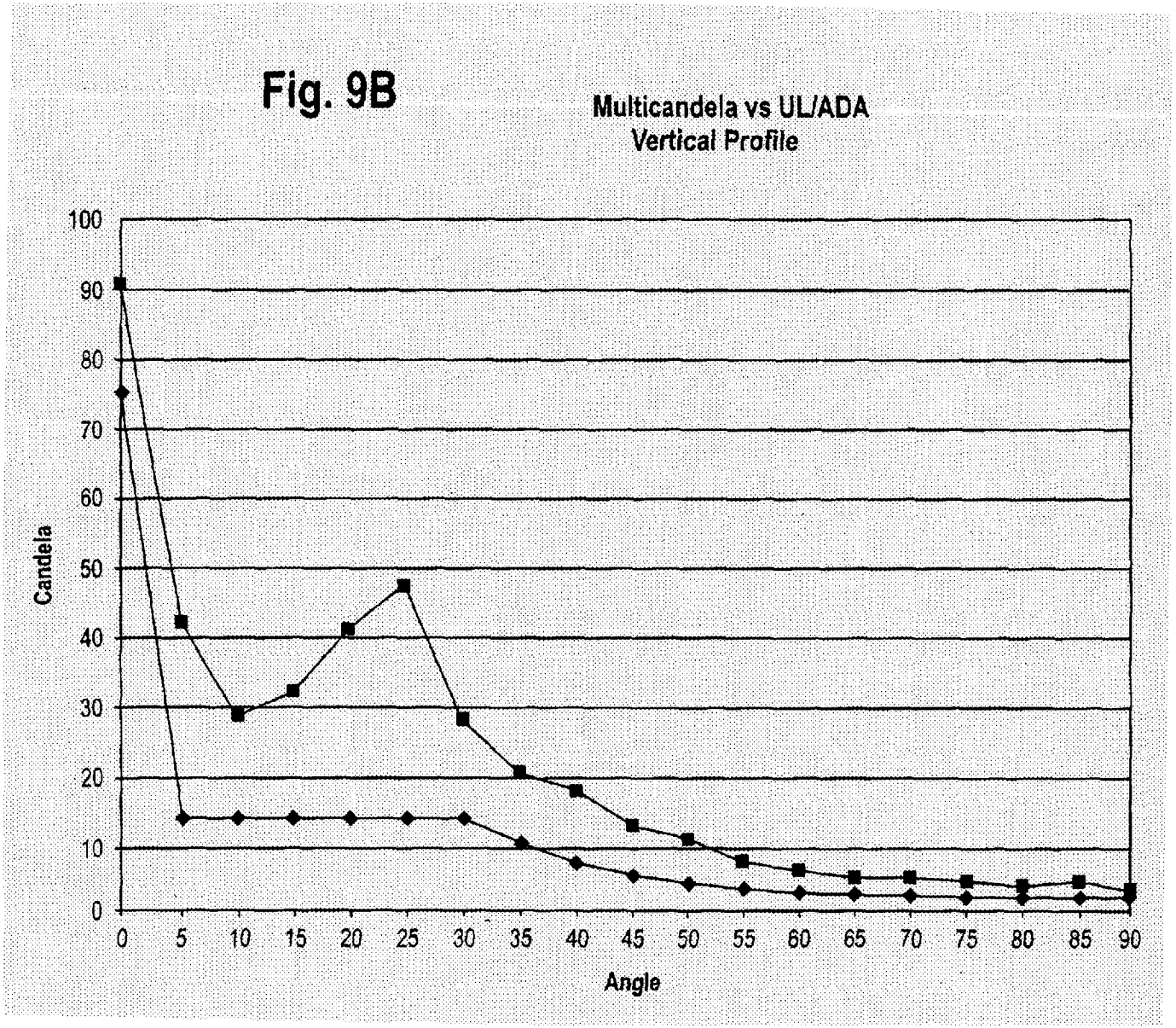
FIG. 9B is a graph of output in the vertical plane of the reflector of FIG. 2 plotted against a composite UL/ADA profile with 75 candela output on axis.

FIG. 9A illustrates a light output profile of reflector 14 for the horizontal plane H plotted against a required composite UL/ADA horizontal plane output profile. FIG. 9B illustrates a light output profile of reflector 14 for the vertical plane V plotted against a required composite UL/ADA vertical plane output profile.

Figure 4:
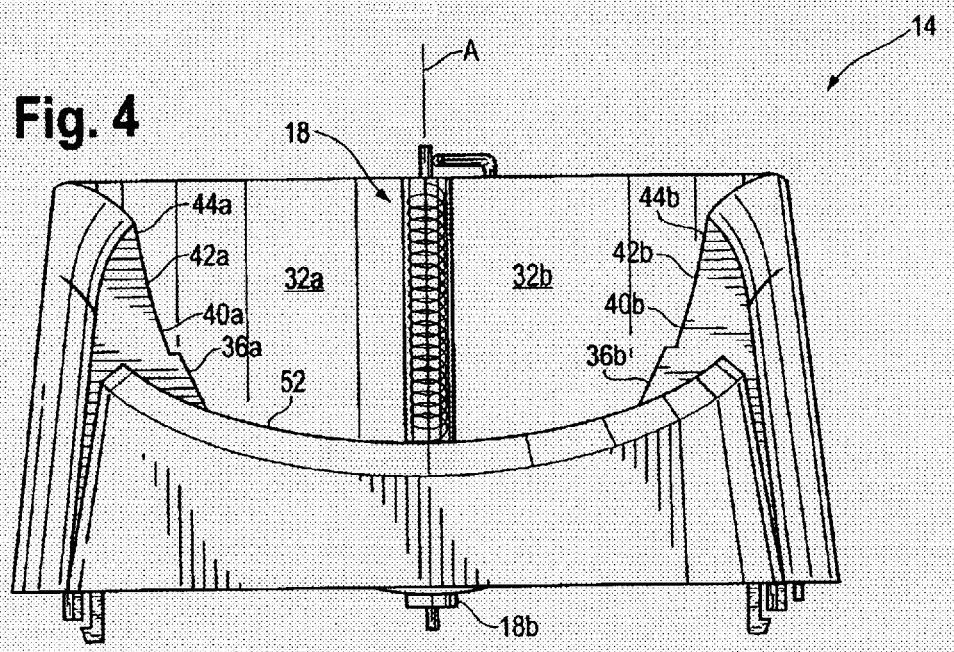
FIG. 4 is a front elevational view of the reflector of FIG. 2.
Figure 5:
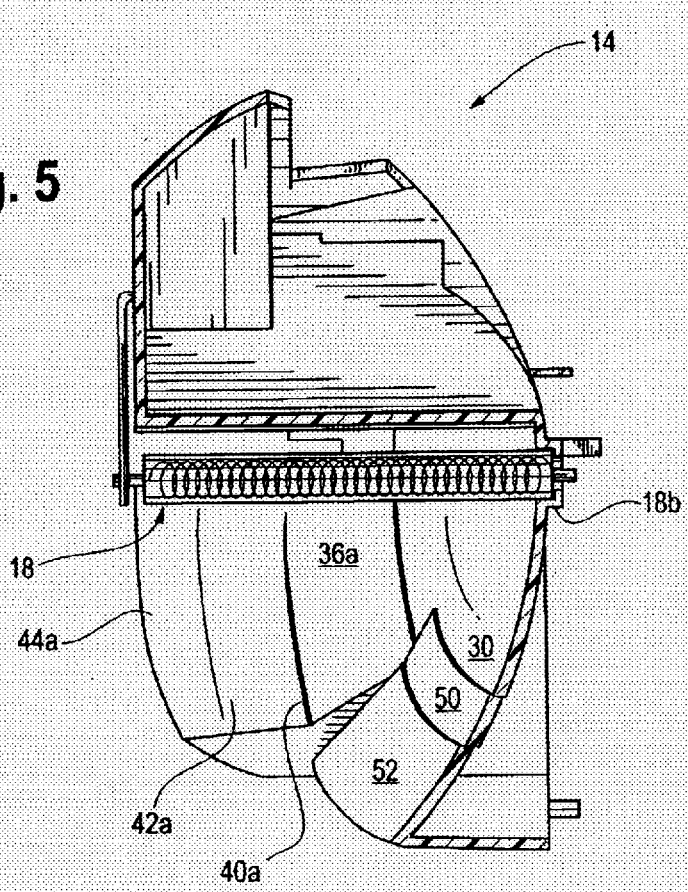
FIG. 5 is a view taken along plane 5—5 of FIG. 3.
Figure 6:
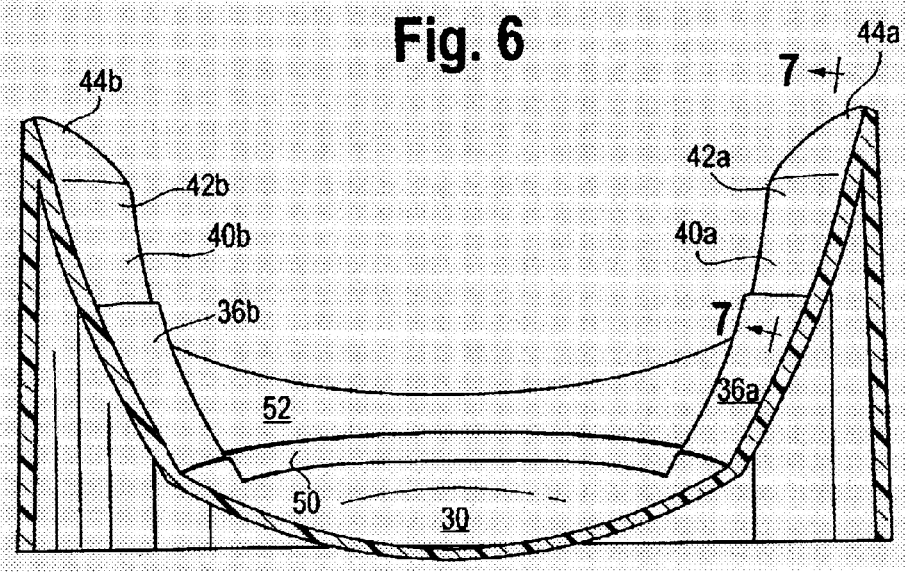
FIG. 6 is a view taken along plane 6—6 of FIG. 3.
Figure 7:
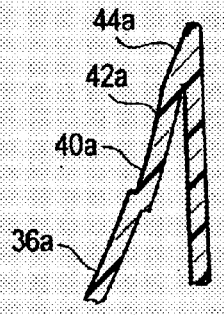
FIG. 7 is a view taken along plane 7—7 of FIG. 6.
Figure 8:
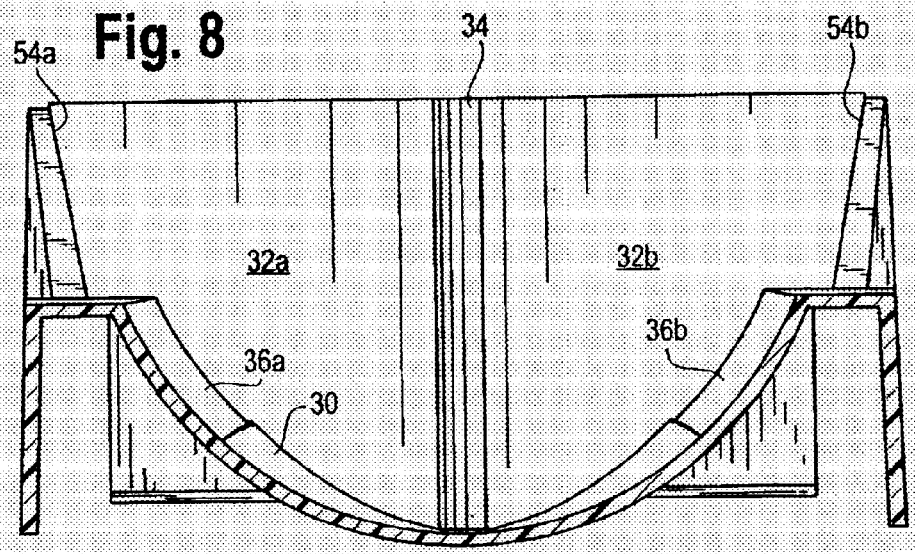
FIG. 8 is a sectional view taken along plane 8—8 of FIG. 3.
Figure 18:
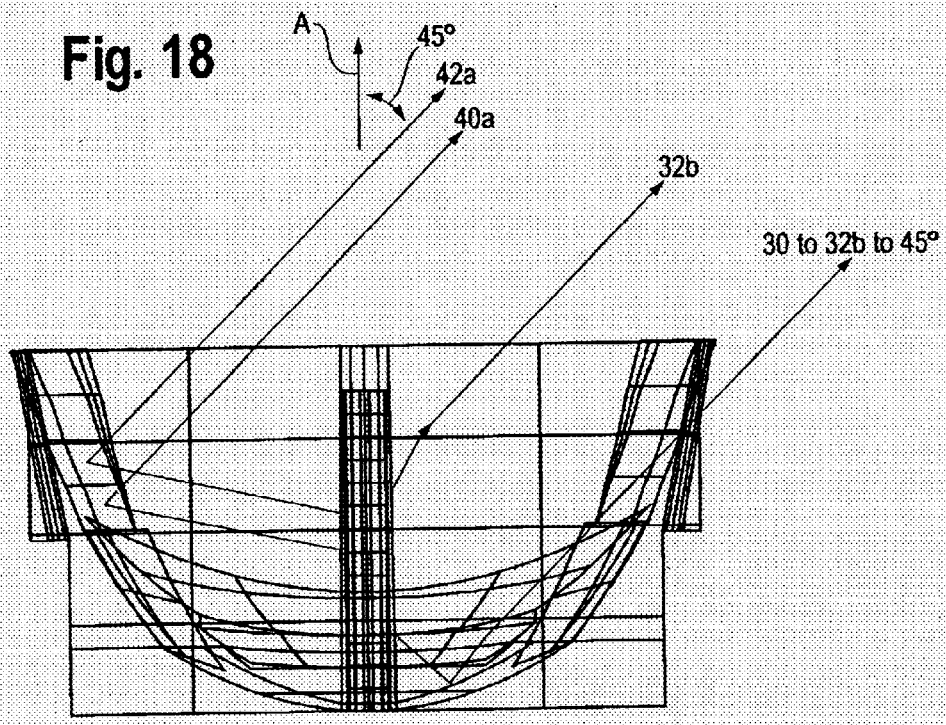
FIG. 18 is a ray diagram illustrating reflections of light rays off of surfaces of the reflector of FIG. 2.
Figure 19:
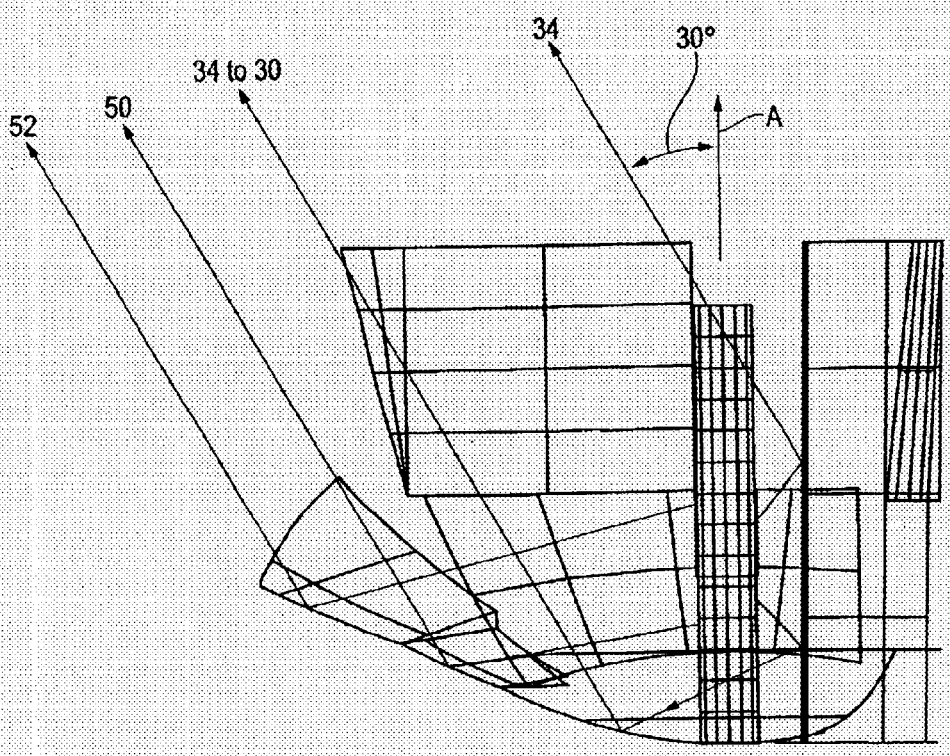
FIG. 19 is another ray diagram illustrating reflections of light rays off of surfaces of the reflector of FIG. 2.
Figure 20:
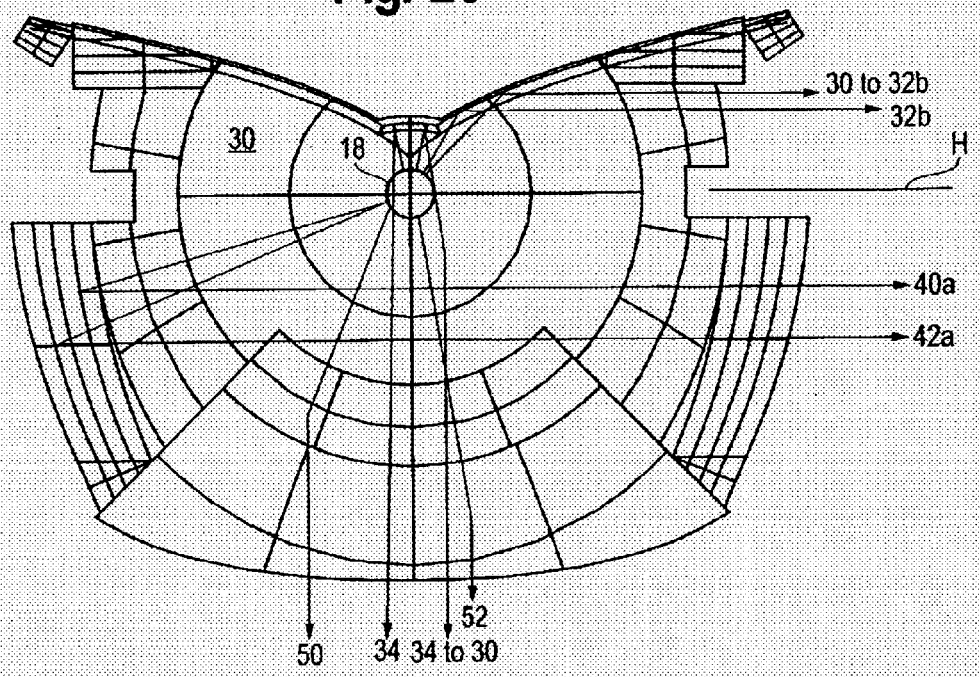
FIG. 20 is yet another ray diagram illustrating reflections of light rays off of surfaces of the reflector of FIG. 2.

FIG. 18 illustrates, with respect to the front elevational view of reflector 14, as in FIG. 4, representative light rays, from source 18 reflected off of various surfaces, 32*b*, 40*a*, 42*a* to an angle forty five degrees, relative to axis A, in the horizontal plane. FIG. 19 is a side elevational view which illustrates light rays from source 18 reflected off of various surfaces to thirty degrees in the vertical plane V, relative to the axis A. FIG. 20 is a top plan view, as in FIG. 3, illustrating the reflected rays of FIGS. 18, 19 in plane H and V.

Figures 14A, 14B:
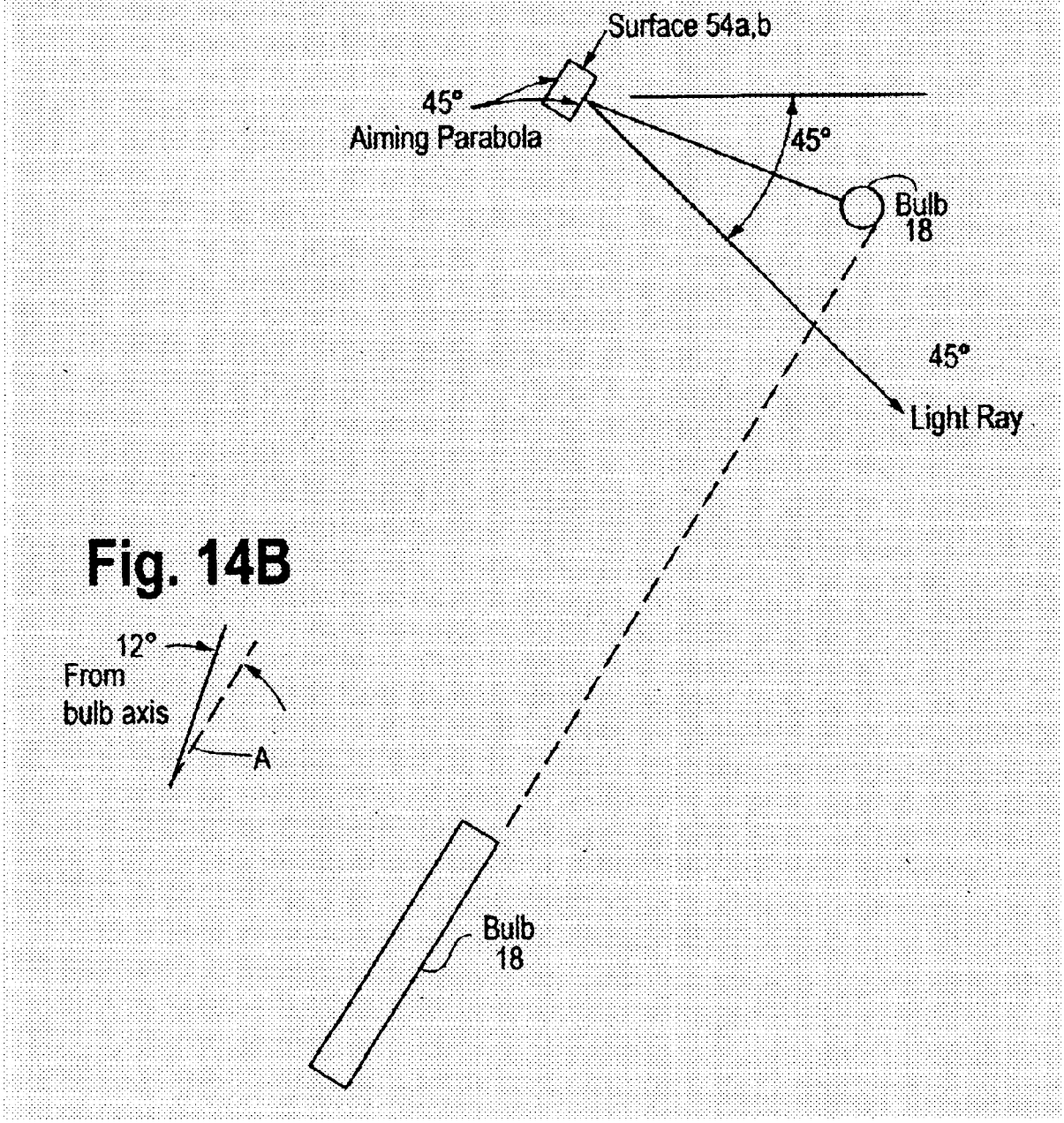
FIGS. 14A, 14B together illustrate characteristics of partial parabolic surfaces located at ends of the reflector surfaces of FIGS. 11A, 11B.

Surfaces 54*a,b* extend from distal ends of surfaces 32*a,b* of reflector 14. Surfaces 54*a,b* are formed of a partial parabola which directs light at an angle of forty five degrees in a plane perpendicular to the axis A. This parabola is extended or swept along a line rotated from or canted back at an angle of about twelve degrees relative to the axis A, best seen in FIG. 14. Surfaces 54*a,b* direct light to a region forty five degrees off the horizontal plane H, forty five degrees off the vertical plane V and forty five degrees of the axis A out from the reflector 14, a so-called compound forty five degree region. This region extends on a ray in a three dimensional coordinate system A, H, V along coordinates (1, 1, 1), (10, 10, 10) and so on.

Figure 21:
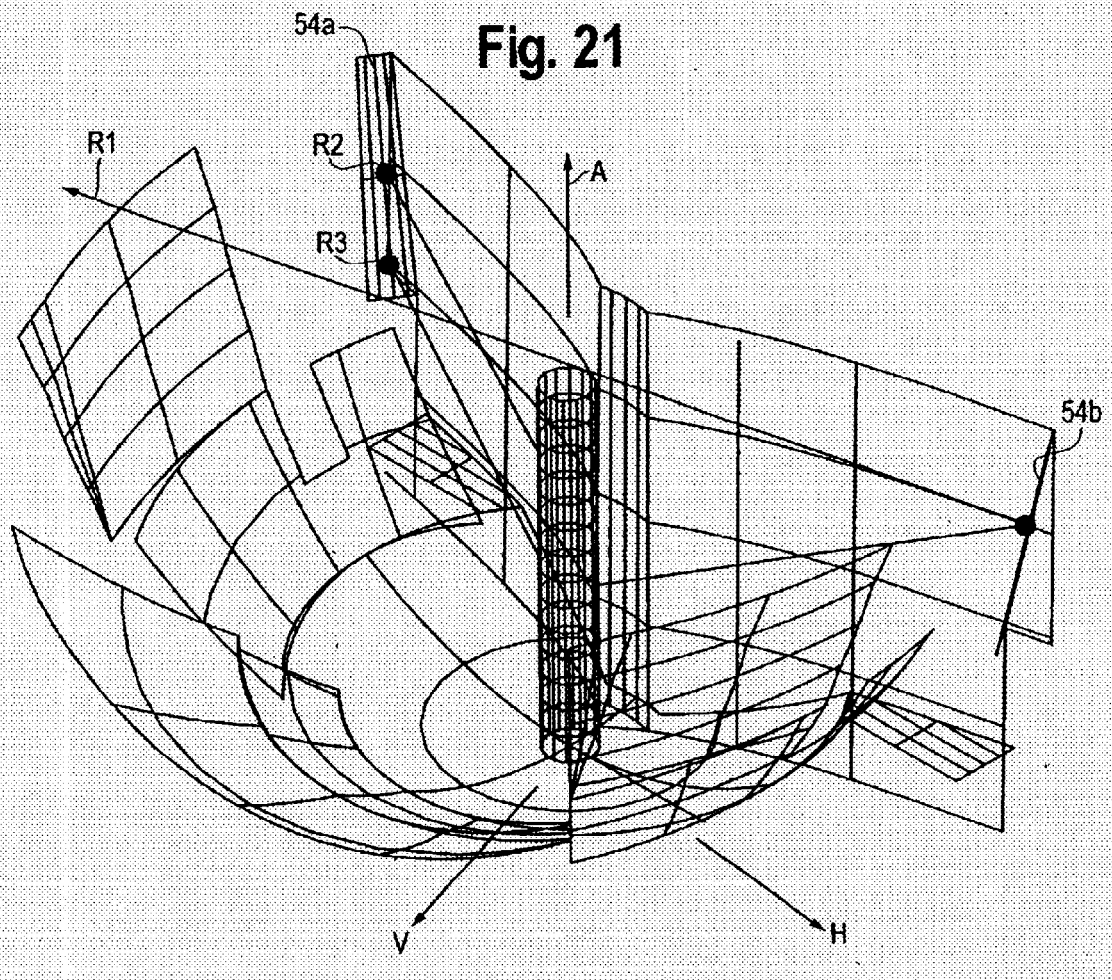
FIG. 21 is a ray diagram illustrating reflections from different surfaces of the reflector of FIG. 2.
Figure 22:
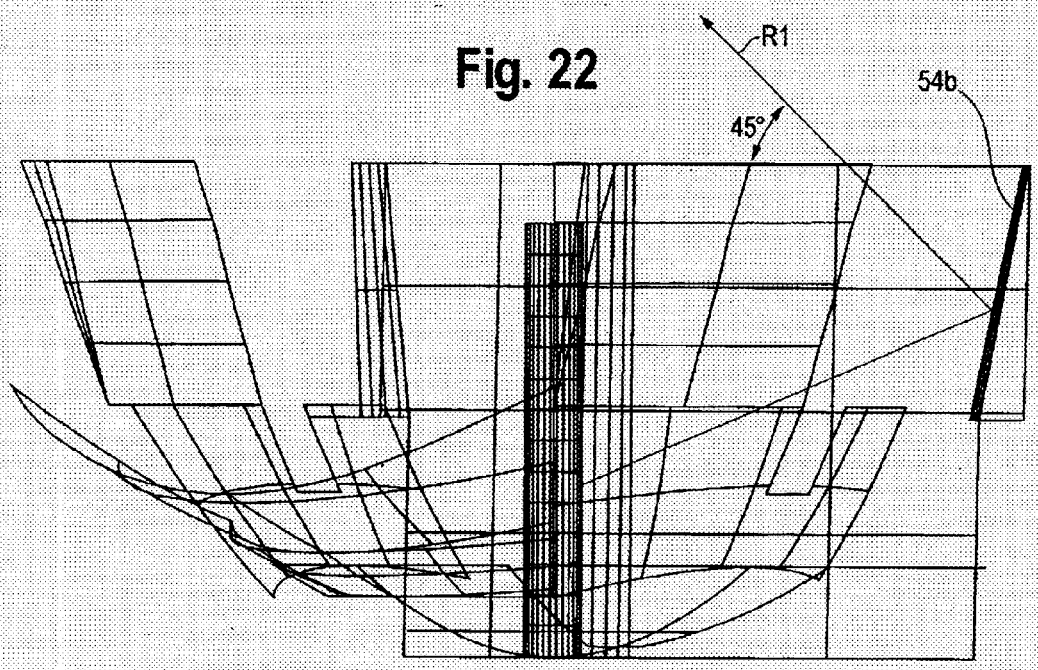
FIG. 22 is a ray diagram illustrating reflections from different surfaces of the reflector of FIG. 2.
Figure 23:
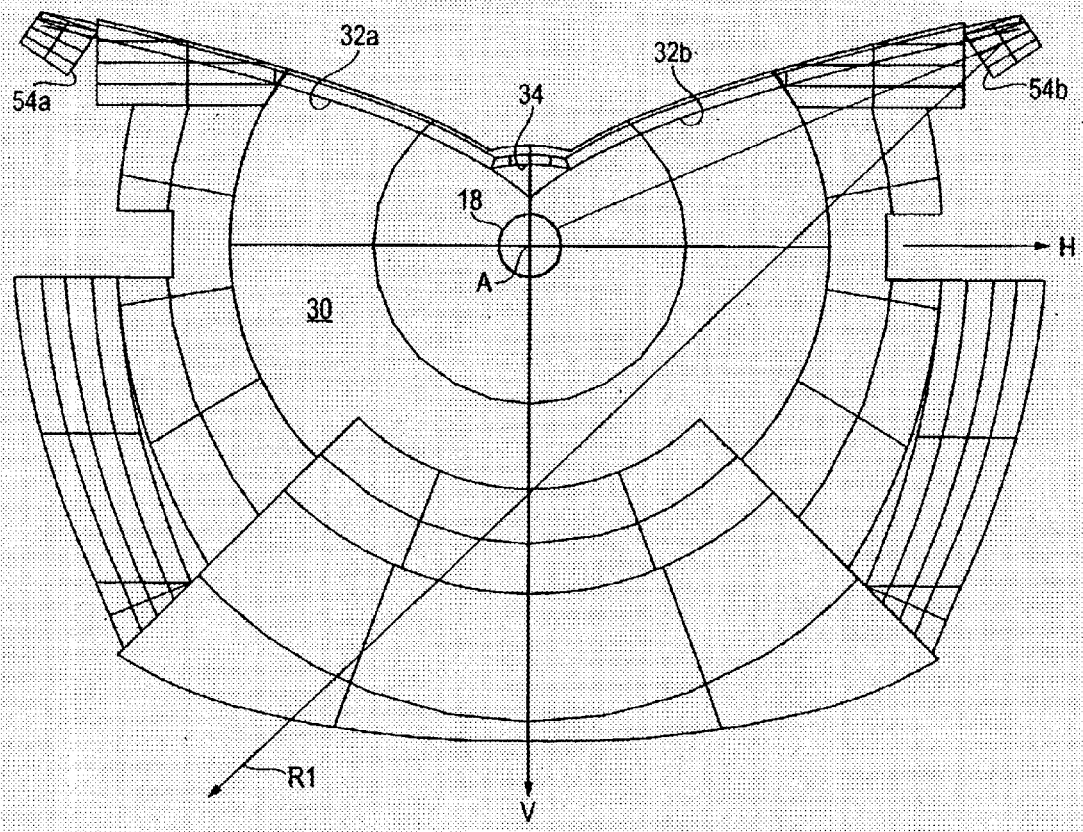
FIG. 23 is another ray diagram illustrating reflections from different surfaces of the reflector of FIG. 2.

FIGS. 21–23 illustrate rays of light from source 18 which are reflected off of surfaces 54*a,b* and directed toward the above noted compound forty five degree region. In FIG. 21 ray R1 is illustrated originating at source 18 is reflected off of surface 54*b* to the compound forty five degree region. Rays R2,3 are illustrated being directed off surface 54*a* directly at the location of the observer of FIG. 21.

FIG. 22 illustrates ray R1 looking parallel to surface 54*b*. Ray R1 is in plane P at forty five degrees to both the horizontal plane H and vertical plane V. FIG. 23 illustrates ray R1 in a top plan view being reflected off of surface 54*b* toward the compound forty five degree region.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A surface mountable reflector has an elongated source of radiant energy which is symmetrical about a central axis, the reflector comprising:

a mounting base with the axis oriented perpendicular to the base;

a first partial parabolic reflector element with a focal point on the axis and formed by a portion of a first parabola rotated at least in part about the axis which focuses output radiant energy in a direction generally parallel to the axis wherein the first parabola is rotated through an angle in excess of ninety degrees; and a second partial parabolic reflector element formed by a rotated portion of the first parabola, attached to a free end of the first reflector element and oriented at a first angle with respect to the axis.

2. A reflector as in claim 1 wherein the first reflector element defines, in part, a curved periphery intersected by at least one partial parabolic surface which extends generally parallel to the axis of rotation.

3. A reflector as in claim 1 wherein the second reflector element defines a partial annular shape and is symmetrical with respect to a plane through the axis.

4. A reflector as in claim 1 which includes a third partial parabolic reflector element also formed by a rotated portion of the first parabola wherein the third parabolic reflector element extends from a free end of the second element at a second angle, greater than the first angle, with respect to the axis and is symmetrical with respect to a plane through the axis.

5. A reflector as in claim 1 which includes a third partial parabolic reflector element also formed by a rotated portion of the first parabola wherein the third parabolic reflector element extends from a free end of the first element wherein portions of the second and third reflector elements abut one another.

6. A reflector as in claim 5 which includes dual, spaced apart, third reflector elements symmetrically arranged with respect to a plane through the axis with the third reflector elements abutting opposite ends of the second reflector element.

7. A reflector as in claim 1 wherein the first reflector element is configured to emit an on-axis output spike of radiant energy in excess of 50 candela.

8. A reflector as in claim 7 wherein the magnitude of the on-axis output spike of radiant energy is at least 75 candela.

9. A reflector as in claim 7 with first and second planes which are perpendicular to one another and which intersect at the axis with the axis extending in at least one of the planes, wherein the planes define regions with predetermined, off axis, radiant energy output profiles; and which includes a plurality of additional spaced-apart reflector elements to emit radiant energy in both planes in accordance with the predetermined output profiles.

10. A reflector comprising a base with an axis extending from the base; first and second groups of partial, annular, stacked, reflective surfaces wherein the groups are spaced apart with the axis between and equidistant from each group with the surfaces oriented to extend in a circular configuration generally perpendicular to the axis.

11. A reflector as in claim 10 which includes a third group of curved, stacked reflective surfaces located between the first and second groups.

12. A reflector as in claim 11 wherein the first and second groups each include at least three different surfaces.

13. A reflector as in claim 11 wherein the third group includes two different surfaces.

14. A reflector as in claim 11 which includes a partial parabolic surface between the axis and the groups to direct light along the axis.

15. A strobe unit comprising:

a housing attachable to a mounting surface;

a three dimensional reflector carried by the housing;

an elongated light source, symmetrical about an axis, wherein the light source and the axis extend from the reflector and the axis lies in a reflector bisecting plane;

a first partial parabolic surface formed in the reflector defined by rotating a parabola about the axis and selecting a first portion thereof as the first surface, with the first surface extending arcuately a common angle on each side of the plane with the surface bounded in part by a first circular periphery displaced from the axis.

16. A unit as in claim 15 which includes a second partial parabolic surface which extends continuously across a second predetermined angle and which abuts part of the circular periphery wherein the second surface comprises a second, different portion of the parabola.

17. A unit as in claim 16 wherein the second surface terminates in a second circular periphery displaced from the first periphery.

18. A unit as in claim 17 wherein the second surface is in part inset into the first surface adjacent to the first circular periphery.

19. A unit as in claim 17 which includes a third partial parabolic surface which abuts part of the second surface at the second circular periphery.

20. A unit as in claim 19 which includes a fourth partial parabolic surface which abuts part of the first surface wherein the fourth partial parabolic surface comprises yet another portion of the parabola.

21. A unit as in claim 20 wherein the fourth surface is displaced to one side of the plane.

22. A unit as in claim 20 which includes dual fourth surfaces which abut different parts of the first surface and wherein the dual surfaces are symmetrical with respect to the plane.

23. A unit comprising:

an elongated illumination element;

first and second minor image partial parabolic reflectors positioned on each side of the illumination element, oriented at a constant radial distance from the illumination element at least relative to a selected plane perpendicularly to the illumination element, and third and fourth mirror image partial parabolic reflectors, the third reflector is positioned on an edge of the first reflector and the fourth reflector is positioned on an edge of the second reflector with the first and third reflector pair and second and forth reflector pair extending generally along the illumination element.

24. A unit as in claim 23 which includes a partial parabolic reflector, symmetrical with and adjacent to the illumination element, with the first and second reflectors displaced thereby.

25. A unit as in claim 23 which includes another partial parabolic reflector located between the first and second reflectors with all reflectors formed by rotating a common parabola about the axis of the illumination element, at least the another reflector is rotated to a different angle relative to the common parabola than are the first and second reflectors.

26. A unit as in claim 23 where the reflectors are all formed by rotating a common parabola about an axis of the elongated member with the third and fourth reflectors rotated to a selected angle relative to the respective first and second reflective elements.

27. A unit as in claim 26 which includes partial parabolic reflector symmetrical with and adjacent to the illumination element with the first and second reflectors displaced thereby.

28. A unit as in claim 26 which includes another partial parabolic reflector located between the first and second reflectors with all reflectors formed by rotating a common parabola about the axis of the illumination element, at least the another reflector is rotated to a different angle relative to the common parabola than are the first and second reflectors.

29. A reflector comprising:

a feature for engagement with a light source, an axis extends from the feature;

first and second curved, partial parabolic surfaces, located equidistant from the axis, wherein the surfaces curve along a ring generally perpendicular to the axis, a third curved, partial parabolic surface that extends between the first and second surfaces wherein the third surface is displaced from the axis a predetermined distance and which includes a fourth curved partial parabolic surface that extends between the first and second surfaces wherein the fourth surface is displaced from the axis a greater distance than is the third surface.

30. A reflector as in claim 29 wherein the fourth surface is rotated away from the axis a predetermined angle.

31. A reflector as in claim 30 wherein the predetermined angle falls in a range of five to fifteen degrees.

32. A reflector comprising:

an elongated source of radiant energy having a ventral axis;

a first partial parabolic reflector element with a focal point on the axis and formed by a portion of a first parabola rotated at least in part about the axis which focuses output radiant energy in a direction generally parallel to the axis wherein the first parabola is rotated through an angle in excess of ninety degrees; and a second partial parabolic reflector element formed by a rotated portion of the first parabola, attached to a free end of the first reflector element and oriented at a first angle with respect to the axis.

33. A reflector comprising:

a feature for engagement with a light source, an axis extends from the feature;

first and second curved, partial parabolic surfaces, located equidistant from the axis, wherein the surfaces curve along a ring generally perpendicular to the axis.

34. A reflector as in claim 33 wherein the surfaces are rotated toward the axis a predetermined angle.

35. A reflector as in claim 34 wherein the angle falls in a range of ten to twenty degrees.

36. A reflector as in claim 33 which includes a third curved, partial parabolic surface that extends between the first and second surfaces wherein the third surface is displaced from the axis a predetermined distance.

37. A reflector as in claim 36 wherein the third surface is rotated away from the axis a predetermined angle.

38. A reflector as in claim 37 wherein the angle falls into a range of three to twelve degrees.

39. A reflector as in claim 36 which includes fourth and fifth partial parabolic surfaces formed by moving a portion of a parabola along an arc relative to the axis.

40. A reflector as in claim 39 wherein the axis is between the first and second and fourth and fifth surfaces.

41. A reflector as in claim 36 which includes a fourth partial parabolic surface, rotated about the axis, adjacent to the feature, and to the first, second and third surfaces.

42. A reflector as in claim 41 which includes a light source coupled to the engagement feature.

43. A reflector as in claim 42 wherein the light source is elongated and extends along the axis.

* * * * *